US006655457B1

(12) United States Patent
Dybdahl

(10) Patent No.: US 6,655,457 B1
(45) Date of Patent: Dec. 2, 2003

(54) METHOD FOR USE IN SAMPLING AND/OR MEASURING IN RESERVOIR FLUID

(76) Inventor: Bjorn Dybdahl, Strandgt. 66, Haugesund (NO), N05528

( * ) Notice: Subject to any disclaimer, the term of this patent is extended or adjusted under 35 U.S.C. 154(b) by 0 days.

(21) Appl. No.: 09/890,117

(22) PCT Filed: Jan. 26, 2000

(86) PCT No.: PCT/NO00/00020

§ 371 (c)(1),
(2), (4) Date: Oct. 18, 2001

(87) PCT Pub. No.: WO00/47870

PCT Pub. Date: Aug. 17, 2000

(30) Foreign Application Priority Data

Jan. 26, 1999 (NO) ..... 990344

(51) Int. Cl.[7] ..... E21B 49/10

(52) U.S. Cl. ..... 166/250.17; 166/250.01; 166/250.12; 166/264; 175/48; 175/50; 175/58; 73/152.26

(58) Field of Search ..... 166/250.12, 250.01, 166/250.17, 252.6, 264; 73/152.04, 152.24, 152.26, 152.23, 152.28, 152.36; 175/40, 48, 50, 58–60

(56) References Cited

U.S. PATENT DOCUMENTS

| | | | | |
|---|---|---|---|---|
| 4,392,376 A | * | 7/1983 | Lagus et al. | 73/152.41 |
| 4,535,843 A | | 8/1985 | Jageler | |
| 5,095,745 A | | 3/1992 | Desbrandes | |
| 5,201,220 A | | 4/1993 | Mullins et al. | |
| 5,337,821 A | | 8/1994 | Peterson | |
| 5,799,733 A | | 9/1998 | Ringgenberg et al. | |
| 6,305,470 B1 | * | 10/2001 | Woie | 166/250.02 |
| 6,328,103 B1 | * | 12/2001 | Pahmiyer et al. | 166/250.17 |
| 6,352,110 B1 | * | 3/2002 | Langseth et al. | 166/264 |

* cited by examiner

*Primary Examiner*—David Bagnell
*Assistant Examiner*—Zakiya Walker
(74) *Attorney, Agent, or Firm*—Fulbright & Jaworski L.L.P.

(57) ABSTRACT

The invention relates to a method for use in sampling, flow measuring, quantity gauging, or possibly other analysis performed in reservoir fluid found in a ground formation. An object of the invention is to perform the sampling, flow measuring and quantity gauging or the remaining analyses in situ on stabilized reservoir fluid that contains a negligible amount drill fluid. Analysis is possible by sealing off an area of the well at the hydrocarbon carrying layer and passing a volume of reservoir fluid into a drill string for analysis by accessories located in the drill string. After the analyses are performed, the reservoir fluid is returned to the hydrocarbon carrying layer.

14 Claims, 1 Drawing Sheet

METHOD FOR USE IN SAMPLING AND/OR MEASURING IN RESERVOIR FLUID

CROSS-REFERENCE TO RELATED APPLICATIONS

The present application claims the benefit of the priority data of Norwegian Application no. 19990344, filed Jan. 26, 1999, and International Application no. PCT/NO00/00020, filed Jan. 26, 2000.

BACKGROUND OF THE INVENTION

1. Field of the Invention

The present invention relates to a method for taking samples, making flow measurements, quantity gauging, and possibly performing other analyses in reservoir fluid run into within a ground formation, for example, when drilling an exploration well for hydrocarbons.

2. Prior Art

Use of new technology in, inter alia, drilling and production in ground formations exhibiting high pressure and temperature, injection of water and gas for increasing the degree of extraction, multiphase production on the seabed and transport of produced hydrocarbons in pipelines on the seabed, makes constantly ever greater demands on maximum knowledge about the physical and chemical properties of the gas, oil and water to be produced from the deposit. Previously, such knowledge about the reservoir fluid within the ground formation was normally provided by means of testing at complete production. However, today there is a clear tendency towards increased use of various sampling tools which, during drilling, are passed down into and pulled up from the well by means of a wire string. The last mentioned method, however, gives fewer possibilities to provide data about relevant parameters of the reservoir fluid than what is possible at full production testing.

Each of the above-mentioned methods has its different advantages and weaknesses. The strength of full production testing is that data can be collected in a large volume of the reservoir fluid, so that the data become very reliable. The main weakness is the large expenses incurred upon, for example, renting a rig and other necessary accessories. Another significant deficiency is that it becomes necessary with one or another form of handling of the large amount of reservoir fluid conducted up to the surface. Today, this takes normally place through undesirable burning of the oil and gas.

Important advantages of use of sampling and measuring accessories lowered down into the well by mans of a wire string, is that samples of the reservoir fluid can be taken continuously during the drilling, and that this can take place with far less expenses than upon full production testing. Nor is it necessary to burn oil and gas. The main weakness of the accessory is, as already mentioned, the limitations in what the accessory can provide of data about relevant parameters for the reservoir fluid. For example, absolutely necessary data about the flowing conditions in the reservoir fluid can not be provided. Nor is the accessory usable in connection with saturated gas reservoir as pressure and temperature can not be stabilized. The weakness is increased further due to the fact that very small amounts of the reservoir fluid are taken out, and that the accessory has to be handled from the surface. Moreover, the last mentioned condition may result in that the measuring results for the reservoir fluid become unreliable. Such errors in the measuring results may be due to, inter alia, the fact that the accessory is not brought into the correct position within the reservoir during the sampling; that the reservoir fluid where samples are taken is contaminated with drilling fluid supplied during the drilling, and that sand accompanying the reservoir fluid during the sampling causes leakage in the accessory.

BRIEF SUMMARY OF THE INVENTION

The above-described problems are solved by the present method. The present method comprises sealing an area of the ground formation's hydrocarbon carrying layer and supplying reservoir fluid from the hydrocarbon carrying layer into a pipe string. Sampling and/or flow measuring, quantity gauging, and possibly other analysis are carried out in the sealed area of the well while the reservoir fluid flows controllably into the pipe string. The reservoir fluid is then returned from the pipe string to the hydrocarbon carrying layer within the ground formation after completing the sampling and analysis.

A great advantage of the present method over prior methods is that the sampling, flow measurements, quantity gauging, or other analysis can be carried out in reservoir fluid positioned down within the hydrocarbon carrying layer. Such reservoir fluid is stabilized as much as possible and, moreover, free of drill fluid.

The supply of reservoir fluid may be controlled by means of a downhole valve or a surface valve. A piston separates the reservoir fluid from water or $N_2$. Subsequent to perforation of the well, the piston moves upward when reservoir fluid is let in with a speed adjusted by means of the valve. Thus, the inflow of reservoir fluid can be measured by reading the amount of liquid (water or $N_2$) which, during the inflow, has flowed into a tank at the surface. When the reservoir fluid has risen so high up in the string that the liquid has reached the security valve, often called the BOP, at the seabed or the surface, the piston is stopped by a seat. Then, all tests are carried out downhole, and the reservoir fluid is pressed back to the reservoir.

Uniform pressure data are achieved due to a stabilized inflow of reservoir fluid into the pipe string. The sampling, flow measurements, quantity gauging or other analyses may be performed with an accessory which is available at any time, so that as much data as possible about the reservoir fluid can be gathered. Trace elements, or tracers, may be added to the reservoir fluid in order to carry out flow measurements, while still returning the reservoir fluid to the hydrocarbon carrying layer from which it was taken.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
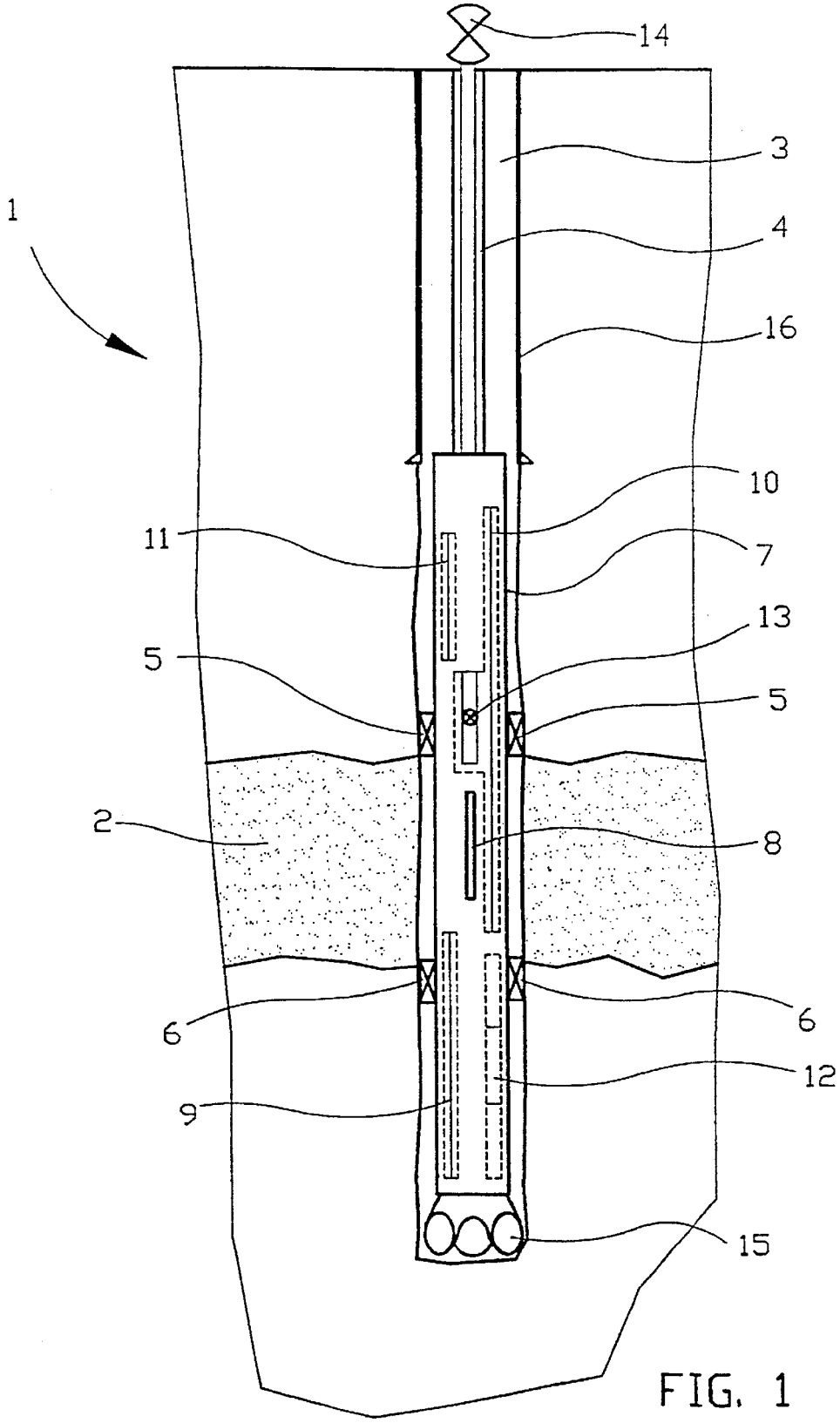
FIG. 1 is a view of a well containing a drill string equipped for in situ analysis.

Turning now to the figures, FIG. 1 shows a diagrammatic detail section within a lower portion of an exploration well which is in the course of being drilled in a ground formation. The well is drilled by means of a drilling accessory comprising a bit located on a drill string. The sampling, flow measuring and quantity gauging or the other analyses of the reservoir fluid are carried out by accessories positioned within a housing member surrounding the drill string above the bit. The well is sealed in an area at the hydrocarbon carrying layer of the ground formation by means of seals located externally on the housing member, and which are expanded to create a seal by resting against the well wall. Examples of accessories for sampling, flow measurements and quantity gauging or other analyses are indicated in FIG. 1 by broken lines.

Sampling, flow measurements, quantity gauging and possibly other analyses are performed in reservoir fluid found in a ground formation 1. Highly accurate measurements are achieved without bringing large volumes of reservoir fluids to the surface by sealing the well 3 in an area at the hydrocarbon carrying layer 2 of the ground formation 1. Reservoir fluid from the hydrocarbon carrying layer 2 is supplied in a drill string 4 which penetrates the sealed area of the well. The sampling, the flow measurements, quantity gauging and other analyses of the reservoir fluid are carried out in the sealed area of the well 3. Preferably, this takes place after the drill string 4 is sealed and filled with reservoir fluid supplied thereto. Thus, the sampling and the respective measurements or analyses take place after a larger amount of the reservoir fluid has been supplied into the drill string 4, thus enabling one to take samples or make measurements in reservoir fluid stabilized after the drilling and substantially lacking in drill fluid content. Inter alia, this is a result of the fact that the previously mentioned piston separates the reservoir fluid from the above positioned water or $N_2$, and where said water or $N_2$ is used to press out drilling mud from the drill string and out into annulus.

After perforation, the piston will move upwardly within the drill string when reservoir fluid is let into the drill string. After sampling and the respective measurements are completed by means of sampling, measuring or analyzing accessories 9–12 which are lowered down into the well 3 together with the drill string 4, the reservoir fluid is returned from the drill string 4 to the hydrocarbon carrying layer 2 in the ground formation 1 in a suitable way. Thereupon, the sampling, measuring or analyzing accessories 9–12 are pulled out from the well 3 together with the drill string 4, so that the limited amount of reservoir fluid accompanying the equipment up to the surface may be further appraised in the laboratory. Thus, avoids the great burden of bringing a large volume of reservoir fluid to the surface. Possibly, the drilling may be continued downwardly towards the underlying layer, so that samples can be taken and measurements or analyses may be made therein in a corresponding way.

Prior to the sampling, flow measurements and quantity gauging or the other analyses, a logging and washout of the well 3 normally will be carried out before the same is sealed. The washout can be made by means of a washing agent which is circulated within the well 3. When reservoir fluid is supplied into the drill string 4, the drill fluid is circulated through a suitable valve between the drill string 4 and the annulus formed between the well wall and the drill string 4, and drill fluid is transferred further from the annulus for storage in tanks, not shown, at the surface. Thus, drill fluid is replaced by gas or liquid ($N_2$/water) prepared for the testing phase by adding a tracer, normally a trace element. Above, it is mentioned that the sampling, flow measurements and quantity gauging or the other analyses in the reservoir fluid are carried out continuously, and after the drill string has been filled in a controlled way with reservoir fluid by means of a downhole valve. However, this does not prevent that the sampling, flow measurements and quantity gauging or the other analyses can take place at another expedient point of time. For example, this may be the case where it is desirable to make continuous measurements while the reservoir fluid is being supplied into the drill string 4.

Further, in FIG. 1, an exploration well 3 is shown, drilled with a bit 15 located on a drill string 4 and which, during drilling, is pressure equalized by means of drill fluid with the tracer added thereto. The drill string 4 may be a coiled tubing or its equivalent. Above the bit 15, the drill string 4 is surrounded by a housing member 7 having a length preferably somewhat larger than the height of the hydrocarbon carrying layer 2 of the ground formation. The housing member 7 may be made of steel having a high durability against an acidic environment that has a high content of chlorides. One end of the housing member 7 is coupled to the drill string 4, possibly the bit 15, in a pressure-tight way. Moreover, the well 3 may be equipped with a casing 16 which either is terminated above the hydrocarbon carrying layer 2 or passed through the same. In the latter case the casing must be equipped with perforations or their equivalent at the layer 2.

The housing member 7 is equipped with expandable seals 5, 6 spaced apart from each other and located externally on the housing member 7, so that the well 3 can be sealed. Seals 5, 6 is placed at the upper and lower sides of the hydrocarbon carrying layer 2. Seals 5, 6 may be placed in alternate locations, for example merely at the central portion of said layer 2. The seals 5, 6 may be of any suitable type. The housing 7 is centralized within the well 3 when the seals 5, 6 are expanded to rest against the well wall in order to create the seal. The length of the housing member 7 and the positioning of the seals 5, 6 are determined on the basis of preceding seismic investigations in the ground formation 1. Moreover, the housing member 7 is equipped with at least one gate 8 or the like, that may be opened so that the reservoir fluid can be supplied into or returned from the drill string 4.

Within the housing member 7, the drill string 4 is equipped with a suitable valve arrangement 13 which is adapted so that the reservoir fluid can pass into or out of the drill 4 string during the supply from or the return into the ground formation 1, respectively. Further, the upper end of the drill string 4 is equipped with an upper valve arrangement 14 which is adapted so that the drill fluid may pass out from or into the drill string independently of whether the reservoir fluid is supplied into or returned from the drill string in the manner previously described. The drill fluid is stored in tanks, not shown, while the reservoir fluid occupies the drill string 4. Moreover, the upper valve arrangement 14 is adapted so that the drill string 4 may be closed when the level of reservoir fluid brought into the drill string has reached up to the upper valve arrangement 14 (e.g. a BOP) or any other desired level in the drill string 4. A preferred means of closing the valve or stopping the fluid is a piston, not shown, that is stopped in a seat.

The housing 7 holds the accessories required for taking the samples and making the measurements necessary for charting relevant properties or parameters of the reservoir fluid. Said accessories for sampling and measuring are selected from the accessories which, at any time, are available on the market, and the housing member 7 may be equipped with other accessories for sampling and measuring than those described. The sampling may be carried out by means of single-phase containers 9 for oil, gas and water. Temperature, pressure, content of $H_2SO$ and $SO_4$, pH-conductivity, density, and C1-value, etc., can be measured by means of a sensor-pipe string system 10. PVT-values (pressure, volume, temperature), IR (infrared radiation) can be measured by means of an acoustic resonance spectroscopy sensor system 11 (Acoustic Resonance Spectroscopy Sensor system). In order to measure flow within the reservoir fluid, the housing member has accessory 12 for adding a suitable tracer for oil, gas and water into the reservoir fluid. Preferably, the tracer is added while the drill string 4 is filled with reservoir fluid and the upper valve arrangement 14 is closed.

Preferably, the housing member 7 is equipped with an acoustic communication system, not shown, so that a higher number of sensor systems for various types of measurements can be placed within the housing member 7 in desired combinations. Said communication system consists of smaller and intelligent communication units coupled to the various sensors within the housing member 7. Thus, sensor data may be transmitted acoustically to a logging or telemetry unit on the surface, without the use of communication cable. This is favorable because transfer of signals by cable, due to the complexity of the sensors or movable parts in the tool, normally is very problematic in tools having a small diameter.

After completing sampling and measurements in the reservoir fluid, and returning the reservoir fluid from the drill string 4 to the ground formation 1, the housing member 7 with the accessories 9–12 assigned thereto, is pulled up to the surface together with the drilling equipment. The equipment concerned is then disconnected from the housing member 7 and brought to the laboratory, so that the reservoir fluid can be analyzed further.

While the presently described embodiment comprises supplying into and returning reservoir fluid from the drill string 4, cases may exist in which the present invention is adapted so that the drill string my be substituted by a tubing string or a "testing" pipe string extending along the drill string 4 and, preferably, between the bit 15 and the valve arrangement 14 at the surface. Further, cases may exist in which it is more suitable that the housing member 7, in lieu of the shown positioning down at the bit 15, is located further up on the pipe string. Likewise, multiple housing members 7 may be employed, each having its own variety of accessories for sampling and measurements, so that simultaneous samples and measurements may be taken from various layers in the ground formation 1.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for use in reservoir fluid measuring operations, carried on as in situ measurements, comprising the steps of sealing a well with a sealing means in an area at a hydrocarbon carrying layer of a ground formation so as to create a sealed off area; extending an elongated pipe string from a surface position downwardly into said sealed off area; conducting reservoir fluid controllably through its own inherent pressure from said hydrocarbon carrying layer into said pipe string; carrying out said measuring operations in situ in the sealed off area by using instrumentation attached to or contained within said pipe string; and returning the reservoir fluid from the pipe string to the hydrocarbon carrying layer after said measuring operations have been completed.

2. A method as claimed in claim 1, wherein said measuring operations comprise sampling, flow measurements, and quantity gauging.

3. A method as claimed in claim 2, wherein said pipe string comprises a gated housing member and the reservoir fluid is conducted into said pipe string through the gate located in said gated housing member.

4. A method as claimed in claim 3, wherein the measuring operations are carried out using a sensor.

5. A method as claimed in claims 4, wherein the gate is closed and opened by means of a valve arrangement located at the upper end of the pipe string.

6. A method as claimed in claim 4, wherein the respective output results from said sensor are converted and transmitted to the surface by means of an acoustic communication system located within the housing member.

7. A method as claimed in claim 2, wherein said sampling, flow measuring, quantity gauging are carried out by means of sampling, flow measuring and quantity gauging accessories located within a housing member.

8. A method as claimed in claim 7, wherein the sampling is carried out by means of single-phase containers for reservoir fluid.

9. A method as claimed in claim 1, wherein the sealing means comprises at least two axially spaced annular packer elements, located externally on a housing member located on a downstream end portion of said pipe string within the area of said hydrocarbon carrying layer.

10. A method as claimed in claim 1, further comprising the steps of sealing the pipe string as soon as said pipe string has been filled with said reservoir fluid; completing said measuring operations; and reopening said pipe string to allow the return of said reservoir fluid to the hydrocarbon carrying layer in the ground formation.

11. A method as claimed in claim 1, further comprising the step of adding tracers to said reservoir fluid.

12. A method as claimed in claim 11, wherein said adding step is performed by means of an admixing accessory located in we a housing member.

13. A method as claimed in claim 1, further comprising the steps of separating the reservoir fluid from a piston drive medium within the pipe string; allowing the reservoir fluid to enter the pipe string; displacing a piston toward the piston drive medium, wherein the piston is contained in the pipe string and is displaced by the reservoir fluid when the pressure of the reservoir fluid is greater than the pressure of the piston drive medium; stopping the displacement of the piston with a seat; moving the piston in the opposite direction of the displacement by means of the piston driving medium; returning the reservoir fluid to the hydrocarbon-carrying layer of the formation.

14. A method as claimed in claim 13, wherein the piston drive medium comprises water or $N_2$, and said seat is positioned at an upper security valve located on the pipe string.

* * * * *